United States Patent [19]

Justice et al.

[11] 4,003,602

[45] Jan. 18, 1977

[54] METHOD AND APPARATUS FOR IN-CUTTING AND OUT-CUTTING DURING COAL MINING

[75] Inventors: James Conley Justice; Frank A. Delli-Gatti, Jr., both of Beckley, W. Va.

[73] Assignee: Coaltex, Incorporated, Beckley, W. Va.

[22] Filed: Jan. 16, 1976

[21] Appl. No.: 649,579

[52] U.S. Cl. ..... 299/18; 299/57; 299/80

[51] Int. Cl.[2] ..... E21C 27/22; E21C 41/00

[58] Field of Search ..... 299/18, 55–57, 299/59, 80

[56] References Cited

UNITED STATES PATENTS

| | | | |
|---|---|---|---|
| 2,734,731 | 2/1956 | Cartlidge et al. | 299/57 |
| 2,970,661 | 2/1961 | Houtcooper | 299/55 X |
| 3,190,698 | 6/1965 | Arentzen et al. | 299/80 X |
| 3,642,325 | 2/1972 | Mulvaney | 299/18 |

FOREIGN PATENTS OR APPLICATIONS

| | | | |
|---|---|---|---|
| 1,340,598 | 9/1963 | France | 299/18 |
| 187,702 | 10/1966 | U.S.S.R. | 299/61 |
| 200,544 | 11/1967 | U.S.S.R. | 299/80 |
| 272,233 | 1/1968 | U.S.S.R. | 299/56 |
| 193,407 | 5/1967 | U.S.S.R. | 299/80 |

*Primary Examiner*—Ernest R. Purser
*Attorney, Agent, or Firm*—Cushman, Darby & Cushman

[57] ABSTRACT

A method and apparatus for forming bores in coal seams and the like and enlarging pre-existing bores. A mining machine includes a non-rotatable body member, a conveyor, such as an auger, in line with the body member, and a pair of wing cutters mounted on the body member for pivotal movement with respect thereto. The wing cutters are movable from a first position wherein they are generally in line with the body member and conveyor, to a second position wherein they are disposed outwardly with respect to the body member. The wing cutters will be in their first position during movement into a bore, and will be moved to and latched in a second position during movement out of the bore. A pilot cutting head in front of the body member may also be provided. The wing cutters may comprise rotatable drums driven by cutting chains, and the drums are normally powered to rotate outwardly from the body member, in directions opposite to each other. A bore may be formed by in-cutting and subsequent out-cutting with the wing cutters in a second position, or a pre-existing bore may be enlarged by moving the machine into the bore, then moving the wing cutters to a second position and withdrawing the machine from the bore.

14 Claims, 5 Drawing Figures

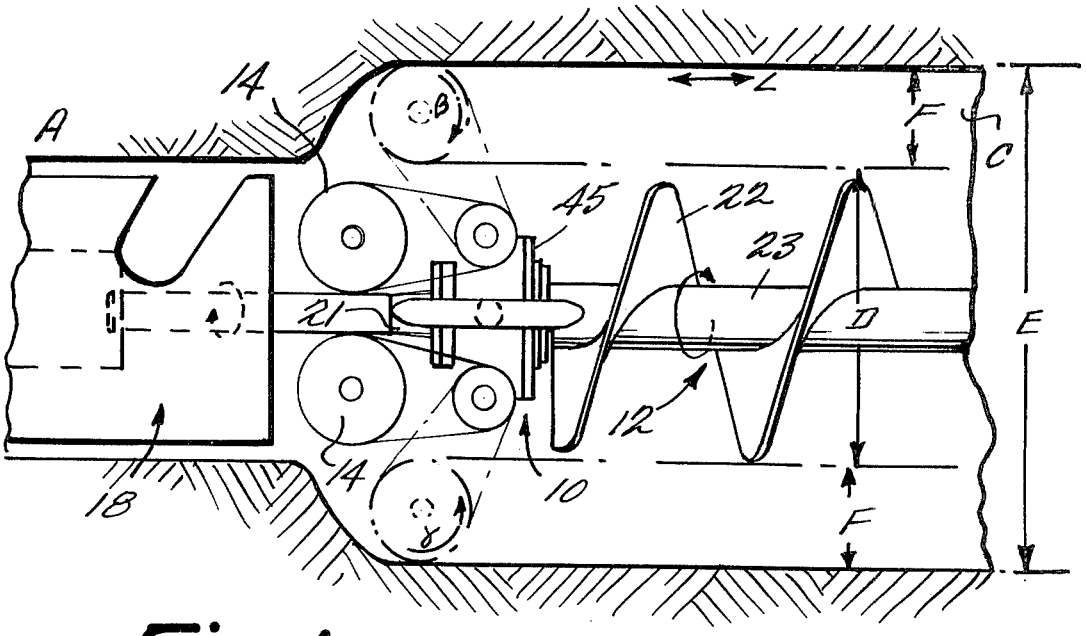
Fig. 1
Fig. 2
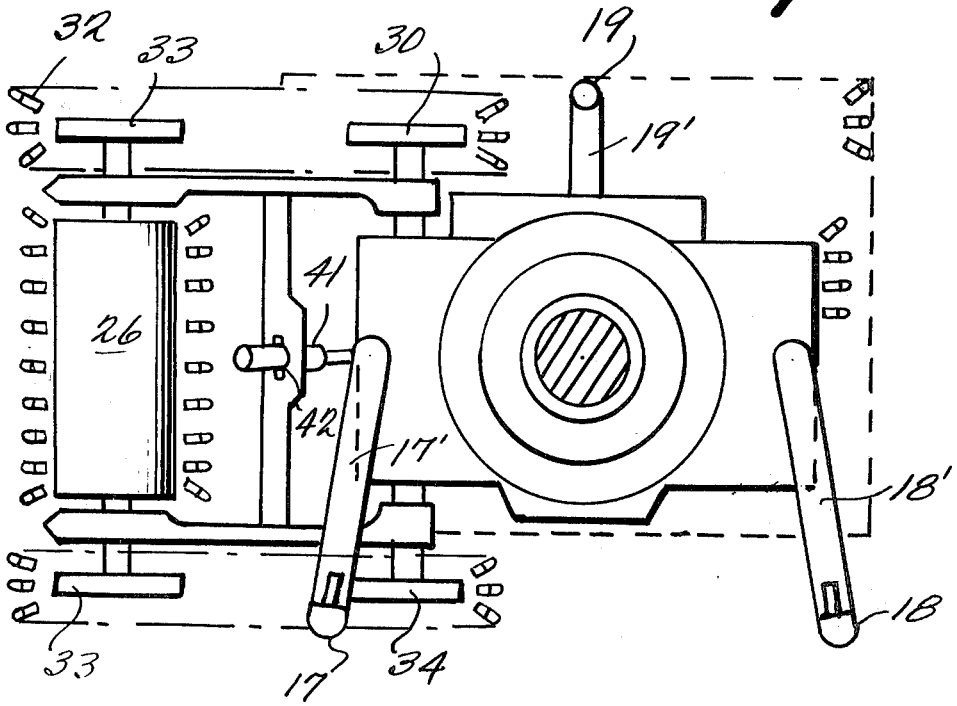

METHOD AND APPARATUS FOR IN-CUTTING AND OUT-CUTTING DURING COAL MINING

BACKGROUND AND SUMMARY OF THE INVENTION

The invention relates to apparatus and a method for the formation and/or enlarging of generally horizontal bores for the mining of coal, ore and the like. In the past, coal has often been mined with conventional auger-miners (such as shown in U.S. Pat. No. 2,784,955) and the like by boring a generally circular cross-section bore into a coal seam. Bores must be spaced far enough from each other to make sure that collapse of the bores does not occur, however, in many older mines these bores are much farther apart than necessary. In mining in such a method, generally the maximum amount of coal is not recovered from an area both because of the shape of the bores and because the area in between bores is wasted.

According to the present invention, apparatus and a method are provided for enlarging pre-existing bores both by changing the cross-sectional shape and the cross-sectional area thereof, and additionally for forming new bores and removing ore during both movement of the mining machine into and out from the bore (the invention is also applicable to underground mining). Conventional mining machines, such as shown in U.S. Pat. Nos. 2,784,955, 3,105,677, 3,121,558, 3,190,698, 3,210,123 and 3,333,898, are capable only of mining during movement of the mining machine into a formation to form a bore therewith, and not during withdrawal of the machine. The machine and method according to the present invention result in the advantages of less wasted set-up time and the like for mining with a machine of a given size, the mining of larger bores with a machine of a given size, and the capacity to retrieve coal, ore, and the like from bores that have previously been made, which coal, ore, and the like has been up to now unusable. All of this can be accomplished with safety since operators are never required to go into the bores being formed or enlarged.

According to the present invention, a mining machine is provided that has a non-rotatable body member in line with a conveying means, and a pair of wing-cutters. The wing-cutters are generally formed by rotatable cutting drums pivotally mounted on lever arms to the body member, and generally driven by cutting chains or the like. During movement of the machine into a pre-existing bore, the wing-cutters are in a position substantially in line with the body member and the conveyor, the mining machine as a whole presenting a cross-sectional area about the same as or slightly less than that of the pre-existing bore. Once far enough into the bore, the wing-cutters are then moved to a position wherein they are disposed outwardly with respect to the body member, and they are held in that outward position while the rotatable drum cutting portions thereof are normally rotated in a direction outwardly from the body member, each drum rotating in a different direction than the other. The machine is withdrawn with the wing-cutters in this position, and cutting takes place the whole time during withdrawal, the coal or the like being thrown toward the conveying means, which preferably comprises an auger.

For both in and out cutting, preferably a pilot cutting head is provided for the machine, in line with the body member and the conveying means. The pilot head preferably is a conventional type such as disclosed in U.S. Pat. No. 2,784,955, the disclosure of which is hereby incorporated by reference in the present application. Also, the chains which drive the cutting drums preferably are cutting chains and they may be arranged so that a circular hole of diameter D cut by the pilot cutting head is enlarged during in-cutting to a square hole of dimension D sides.

It is the primary object of the present invention to provide an improved method and apparatus for the mining of coal, ore, and the like. This and other objects of the invention will become apparent from an inspection of the detailed description of the invention, and from the appended claims.

BRIEF DESCRIPTION OF THE DRAWINGS

FIG. 1 is a top plan view showing an exemplary machine according to the present invention schematically, in operation during cutting;

FIG. 2 is a front view, with the pilot head cut away, of the machine of FIG. 1;

DETAILED DESCRIPTION OF THE INVENTION

Figure 3:
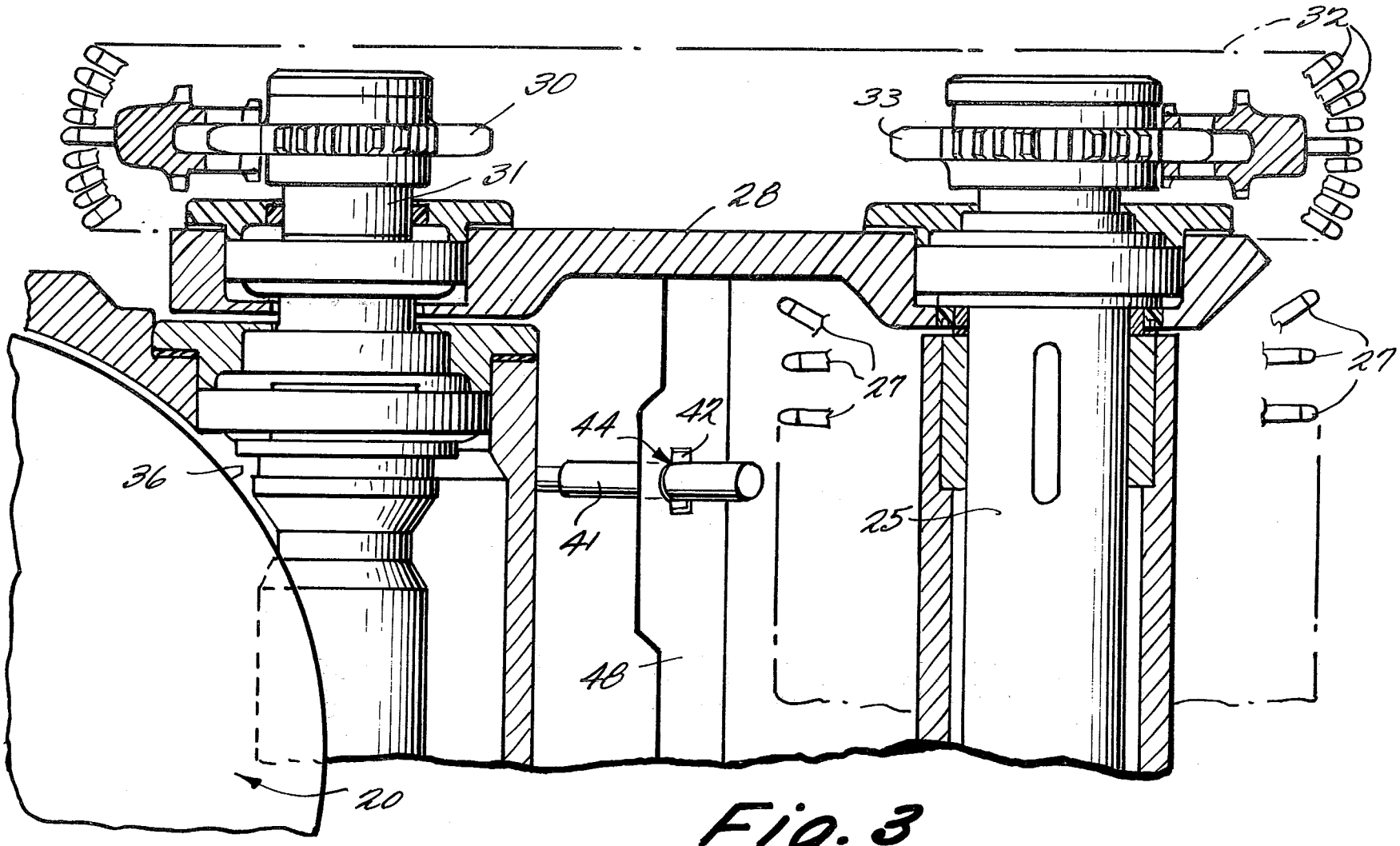
FIG. 3 is a detail view, partly in cross-section and partly in elevation, of a portion of a wing cutter with drive means therefore of the machine of FIG. 1.

An exemplary mining machine according to the present invention is shown schematically in FIG. 1. The machine generally comprises a non-rotatable body member 10, conveying means 12 in line with the body member 10 and for conveying cut coal and the like from the cutting site, and a pair of wing cutters, 14, for cutting coal during back-movement of the machine from a bore A in which it is inserted. A pilot cutting head 16 preferably is provided in front of the body member 10, in line with the member 10 and conveying means 12, to provide for in-cutting with the machine, as well as the out-cutting therewith provided by wing cutters 14. The pilot head preferably comprises a conventional type such as shown in U.S. Pat. No. 2,784,955, the disclosure of which is hereby incorporated by reference in the present application. Ski runners 17, 18, and 19 or the like are provided attached to the body member 10 for "keying" the body member into the bore to prevent rotation thereof, and for stabilizing it during cutting.

The legs 17', 18', 19' supporting the ski runners 17, 18, 19 may have the length or position thereof manually adjusted (as with shims) or automatically adjusted by power means, such as a hydraulic cylinder. Such means may be used for guidance purposes, and be operable in response to a securing means.

The body member 10 contains a transmission, shown generally at 20 (see FIG. 3) therein, which transmission 20 is operatively connected to the pilot cutting head coupling 21 or the like, and is connected at the other end thereof to a drive shaft (not shown) extending through the conveying means 12. Preferably, the conveying means 12 is an auger 22 so that the drive shaft may extend through the middle shaft 23 thereof.

Each of the wing cutters 14 preferably includes a shaft 25 that is rotatable about a generally vertical axis during use of the mining machine, a cutting drum 26 mounted for rotation with the shaft 25 and having teeth 27 formed on the periphery thereof, and one or more (preferably at least two) lever arms 28 pivotally mounting the shaft 25 to the body member 10. A drive sprocket 30 is mounted on a drive shaft 31 which extends from transmission 20 through upper arm 28 to a position above body member 10, and sprocket 30 is mounted to a cutting chain 32; the drive sprocket 30 drives a driven sprocket 33 mounted to shaft 25, above arm 28, via chain 32. The cutting chain 32 may be of any conventional type, such as Cincinnati Rap-Lok Chain No. 1997. The driven sprocket 33 is preferably larger than the drive sprocket 30 so that draft is allowed when the chain 32 is not in line with the dimension L of the bore A. A cutting chain 32 is also provided on the bottom of each drum 26, also attached to a sprocket 33, and to a sprocket 34. The sprocket 34 may either be an idler sprocket, or it may be connected to shaft 31 at the bottom thereof, opposite sprocket 30. The transmission 20 for driving the cutting drum 26 and cutting chains 32 preferably includes a circular gear 36 or the like connected to the shaft extending through the conveying means 12, and a worm gear 37 connected to shaft 31. As the circular gear 36 is driven, powered by a diesel engine or the like located exteriorly of the bore A, it rotates the worm 37, which powers the whole wing cutter assembly 14. The speed of rotation of the gear 36 is of course variable.

Figure 4:
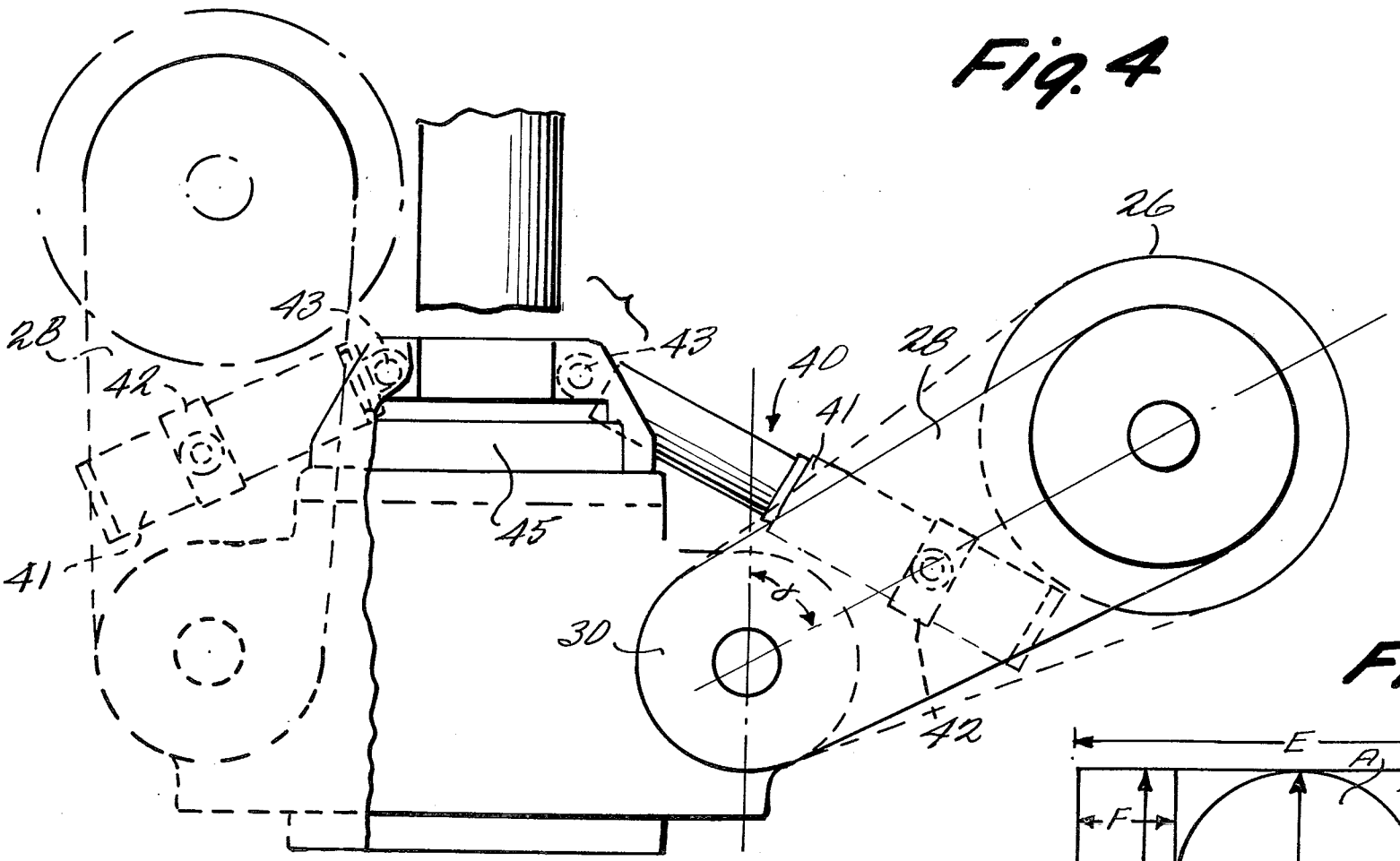
FIG. 4 is a top view, with portions cut away for clarity, of exemplary means for moving the wing cutters with respect to the body member of the machine of FIG. 1.

Each of the wing cutters 14 is pivotally mounted, by arm(s) 28, to the body member 10 so that thay are movable from a first position (shown in solid line in FIG. 1) wherein they are generally in line with the body member 10 and conveying means 12 (the arms 28 generally being parallel to a line through body member 10, pilot head 16, and conveyor means 12), to a second position (shown in dotted line in FIG. 1) wherein they are disposed outwardly with respect to the body member 10, the arms 28 making an angle $\alpha$ with respect to the in-line first position thereof. Means, shown generally at 40, are provided for moving the cutter means 14 from the first position thereof to a second position thereof, and vice-versa. Such means 40 may take the form of a hydraulic cylinder 41, such as shown in FIGS 3 and 4, especially, mounted by a bracket 42 adjacent one end thereof in an opening 44 in a support 46 extending between arms 28, and at the other end thereof by a pin 43 or the like to the body member 10, or an extension thereof. Of course more than one cylinder 41 could be provided with each support 46 or like structure if desired. Adjustable control means 45 or the like are provided for controlling the extension of cylinder 41 to in turn control the extent the arm 28 is pivoted outwardly with respect to the body member 10 (control the magnitude of the angle $\alpha$). The control means 45 provide for latching of the cylinder 41 into any position to which it is moved. The extent to which it is desired to extend each cylinder 41 will depend upon the particular bore involved, the position which will maximize the cutting forces, etc., and one cylinder 41 can be extended to a greater extent than the other if desired in some circumstances.

The cutting drums 26, and associated cutting chains 32, are preferably rotated outwardly with respect to the body member 10, the direction of rotation of each drum 26 being opposite the direction of rotation of the other drum. That is, the right-side drum 26, as viewed from the conveying means 12, preferably rotates in direction $\beta$ (clockwise) so that coal or the like cut thereby is thrown toward the auger 22, and the left-side drum 26 preferably rotates in the direction $\gamma$ (counterclockwise) so that coal or the like cut thereby is thrown toward the auger 22.

An exemplary operation of the mining machine according to the present invention for both cutting in and out, will now be described. The cylinders 41 are retracted so that the wing cutters 14 are disposed in their first, in-line position (solid line in FIG. 1) with the body member 10. An engine located exterior of the area to be mined is started up and the pilot head 16 is powered by a shaft extending from the exterior area, through auger 22 and transmission 20, to the pilot head 16. The pilot head 16 cuts a generally circular bore A having a diameter D. As the coal or the like is cut by the pilot head 16, it is automatically moved backwardly toward the auger conveyor 22, which has substantially the same diameter D as the bore A being formed by pilot head 16. During this time, while the wing cutters may be powered (or a clutch or the like could be provided with transmission 20 to cut-out the wing cutters 14 during in-cutting), the wing cutter drums 26 perform no substantial cutting, although they can be at a slight angle $\alpha$ to perform a small amount of cutting and to insure clearance of cylinders 41 during outward movement. Once the desired depth is reached for bore A, the cylinders 41 are extended a desired amount (i.e. dotted line position of FIG. 1), while the wing cutters 14 are being powered through the transmission 20 by the drive sprockets 30 and the like, and the mining machine is withdrawn from the bore A. During the withdrawal operation a generally rectangular bore C is formed, having a width E, equal to the diameter D plus the amount F each cutting drum 26 extends from the bore A in a dimension M, perpendicular to the dimension L of the bore A, and having a height D. The dimension F cannot be greater than the diameter of the cutting drums 26 unless a string of wing cutters 14 is provided on each side of the body member 10, mounted on arms (28) of various lengths. The cut coal or the like is thrown toward the auger 22 due to the direction of rotations, $\beta$ and $\gamma$ respectively, of the right-hand and left-hand cutting drums 26. Once the entrance of the bore A is approached, the wing cutters 14 are collapsed to their first, generally in-line position, and the whole mining machine withdrawn (an area of bore A, instead of bore C, is desirably left adjacent each bore entrance).

Preferably, as shown in the drawings, the cutting chains 32 are so arranged that during in-cutting with the pilot head 16, the circular bore of diameter D is transformed by the cutting chains 32 into a generally square bore G having each side of dimension D. The cut coal or the like is of course continuously withdrawn from the bore G by the auger 22.

It will thus be seen that according to the present invention, a machine has been provided that allows the cutting of a much larger amount of coal for a machine of a giving size during one entry and exit operation, contributing to economy of removal (and making auger mining practical). It is noted that this is accomplished essentially without danger to any operators since the operators have no reason to enter a bore A, G, or C. Should collapse of a bore result, while the mining machine will be lost, no loss of human life will ensue.

Figure 5:
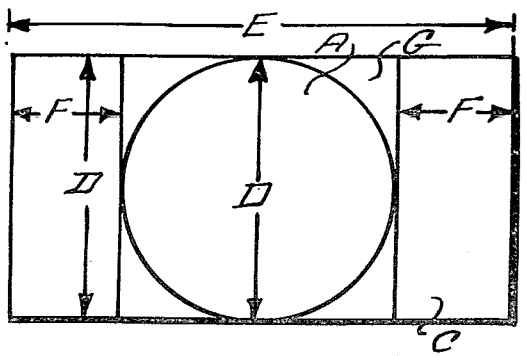
FIG. 5 is a schematic view of exemplary bores formed according to the present invention.

According to another aspect of the present invention, utilizing the mining of the present invention either with or without the pilot cutting head 16, enlargement of pre-existing bores in coal or ore seams or the like may be effected. This is accomplished merely by inserting the mining machine into an already pre-existing bore A or the like, with the wing cutters in their retracted, generally in-line position so that the cross-section area of the mining machine is substantially the same as or less than the cross-sectional area of the bore A. If the chains 32 are arranged for square-bore cutting, of course some enlargement of the bore A will occur during the inward movement, but all cut or loose coal will be removed from the bore A by the auger 22. Essentially, however, there will be little cutting during the inward movement, although the wing cutters 14 can be disposed at a small angle $\alpha$ to insure clearance of the cylinders 41 during outward movement from the bore. Once the desired depth (or the end of the bore A) is reached, the cylinders 41 move the cutting drums 26 outwardly a desired angle $\alpha$ (dotted line position, FIG. 1) while they and the cutting chains 32 are being powered, and the mining machine will be withdrawn. During withdrawal, the cut coal or the like will be thrown toward the auger 22, and carried to the exterior of the bore thereby. A bore C is the final result, the bore C being larger than the bore A (see FIG. 5).

While it is preferred that the method and apparatus according to the present invention be primarily utilized for coal mining, it is to be understood that ore and the like may also be mined thereby. The term "coal or the like" in the claims is thus intended to encompass coal, and a variety of ores and similar materials.

While the invention has been herein shown and described in what is presently conceived to be the most practical and preferred embodiment, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A mining machine for cutting an in-bore and an out-bore larger than said in-bore during in-cutting and out-cutting respectively, comprising a. a non-rotatable body member, with stabilizing means for insuring non-rotative movement of said body member in a bore, b. a rotatable pilot cutting head, mounted in front of said body member, and means for rotating said pilot cutting head for cutting a generally circular in cross-section bore, c. a pair of wing cutters pivotally mounted to said non-rotatable body member behind said pilot head in non-interfering relationship with said pilot head, d. conveying means mounted behind said wing cutters in operative association with said body member, for conveying coal or the like cut by said pilot head and said wing cutters away from the cutting site, e. means for pivotally moving said wing cutters with respect to said non-rotatable body member from a first position, wherein said wing cutters are in general alignment with said pilot cutting head and body member, during in-cutting, to a second position wherein each of said wing cutters extends outwardly with respect to said pilot cutting head, during out-cutting, and f. means maintaining said wing cutters in said second positions thereof during out-cutting thereby.

2. A mining machine as recited in claim 1 wherein each of said wing cutters comprises a drum shaft adapted to rotate about a generally vertical axis, a toothed cutting drum operatively connected to said drum shaft, for rotation therewith, a lever arm pivotally mounting said drum shaft to said body member, and power means for rotating said cutting drum shaft, said drums of said mining machine rotating in opposite directions from each other and rotating outwardly from said body member.

3. A mining machine as recited in claim 2 wherein said power means for each of said wing cutters comprises a cutting chain, a drive sprocket mounted on said body member for operative association with said chain, and a driven sprocket mounted on said drum shaft for operative association with said chain.

4. A mining machine as recited in claim 3 wherein said driven sprocket is larger than said drive sprocket.

5. A mining machine as recited in claim 3 wherein a cutting chain is disposed both generally vertically above and vertically below each cutting drum, and wherein said cutting chains operate both during in-cutting and out-cutting to form a bore generally square in cross-section.

6. A mining machine as recited in claim 3 further comprising means located generally within said body member for driving said drive sprockets, said means comprising a powered circular gear and a worm for each wing cutter in operative association with said circular gear, each said worm operatively connected to a drive sprocket by a shaft adapted to be generally vertically disposed.

7. A mining machine as recited in claim 6 wherein said conveying means comprises an auger conveyor in line with said body member and said pilot head, and wherein a drive shaft for said powered circular gear extends through the interior of said auger from a remote engine.

8. A mining machine as recited in claim 2 wherein said means for moving said wing cutters from a first position to a second position thereof includes a hydraulic cylinder operatively connected to said lever arm and said body member associated with each wing cutter.

9. A mining machine as recited in claim 1 wherein said conveying means comprises an auger conveyor in line with said body member and said pilot head.

10. A mining machine as recited in claim 1 wherein said stabilizing means comprises a pair of floor ski runners, and a top ski runner mounted generally intermediate said floor ski runners, all mounted to said body member.

11. A mining machine for enlarging a pre-existing bore by out-cutting, said machine comprising a. a non-rotatable body member, b. a pair of wing-cutters pivotally mounted to said body member, having rotatable cutting portions thereof, c. conveying means mounted behind said wing cutters in operative association with said body member, for conveying coal or the like cut by said wing-cutters away from the cutting site, d. means for pivotally moving said wing cutters with respect to said body member from a first position, wherein said wing cutters are generally in line with said body member and said conveying means and no substantial amount of coal or the like is cut thereby, to a second position wherein each said wing cutter extends outwardly with respect to said body member, making an angle with a line between said body member and said conveying means and in which second position substantial amount of coal or the like is cut thereby, e. means maintaining said wing cutters in said second position during out-cutting, and f. means for rotating the rotatable cutting portions of said wing cutters.

12. A mining machine as recited in claim 11 wherein said means for rotating the rotatable cutting portions of said wing cutters includes means for rotating said portions outwardly with respect to said body member, each cutter rotating in a direction opposite said other cutter.

13. A method of increasing the recovery material from the area of a pre-existing generally horizontal generally circular in-cross-section bore of a diameter D in a coal seam or the like utilizing a mining machine having out-cutting means associated therewith which are movable from a first generally inoperative position to a second generally operative position, said method comprising the steps of a. inserting the mining machine into the pre-existing bore from an exterior area, and reboring the pre-existing bore during in-movement of the mining machine, b. continuously conveying the cut coal or the like from the bore to the exterior area during in-movement of the mining machine, c. moving the mining machine out-cutting means from the first position to the second position thereof and maintaining said means in the second position thereof during out-cutting, d. withdrawing the mining machine from the pre-existing bore to enlarge the pre-existing bore to a bore having a generally rectangular configuration having at least one side thereof having a dimension greater than D, out-cutting taking place during withdrawal, and e. continuously conveying cut coal or the like from the bore during out-cutting.

14. A method as recited in claim 13 comprising the further step of enlarging the pre-existing bore during insertion of the mining machine into the pre-existing bore to form a bore having a generally square cross-section of each side D.

* * * * *